US006034649A

United States Patent [19]

Wilson et al.

[11] Patent Number: 6,034,649

[45] Date of Patent: Mar. 7, 2000

[54] DUAL POLARIZED BASED STATION ANTENNA

[75] Inventors: John S. Wilson, Downers Grove; Howard W. Davis, Darien; Peter J. Bisiules, LaGrange Park; Charles A. Bibblecom, Naperville; Lawrence S. Racana, Willow Brook; David J. Ulery, Warrenville, all of Ill.

[73] Assignee: Andrew Corporation, Orland Park, Ill.

[21] Appl. No.: 09/172,329

[22] Filed: Oct. 14, 1998

[51] Int. Cl.[7] ..... H01Q 9/28

[52] U.S. Cl. ..... 343/795; 343/797; 343/872

[58] Field of Search ..... 343/795, 797, 343/789, 853, 906, 872, 702, 821

[56] References Cited

U.S. PATENT DOCUMENTS

| | | | |
|---|---|---|---|
| H001460 | 7/1995 | Davis | 343/700 MS |
| 2,130,033 | 9/1938 | Scharlau . | |
| 2,455,403 | 12/1948 | Brown . | |
| 3,196,443 | 7/1965 | Martin | 343/797 |
| 3,482,253 | 12/1969 | Zucconi . | |
| 3,496,570 | 2/1970 | Lewis . | |
| 3,680,139 | 7/1972 | Reynolds, Jr. | 343/756 |
| 3,680,143 | 7/1972 | Ajioka et al. | 343/778 |
| 3,681,769 | 8/1972 | Perrotti et al. | 343/814 |
| 3,681,771 | 8/1972 | Lewis et al. | 343/817 |
| 3,718,935 | 2/1973 | Ranghelli et al. | 343/797 |
| 3,720,953 | 3/1973 | Ajioka | 343/771 |
| 3,740,754 | 6/1973 | Epis | 343/797 |
| 3,742,506 | 6/1973 | Wilkinson | 343/854 |
| 3,747,114 | 7/1973 | Shyhalla | 343/795 |
| 3,750,185 | 7/1973 | Evans | 343/814 |
| 3,810,185 | 5/1974 | Wilkinson | 343/756 |
| 3,821,742 | 6/1974 | Pollard | 343/727 |
| 3,922,680 | 11/1975 | Alsberg et al. | 343/754 |
| 4,015,263 | 3/1977 | Koerner et al. | 343/708 |

FOREIGN PATENT DOCUMENTS

| | | |
|---|---|---|
| 922 8386 | 5/1993 | Australia . |
| 952 7118 | 2/1996 | Australia . |
| 0 416 300 | 3/1991 | European Pat. Off. . |
| 0 464 255 | 1/1992 | European Pat. Off. . |
| 0 523 770 | 1/1993 | European Pat. Off. . |
| 0 566 522 | 10/1993 | European Pat. Off. . |
| 0 647 977 | 4/1995 | European Pat. Off. . |
| 0 657 956 | 6/1995 | European Pat. Off. . |
| 0 495 507 | 11/1995 | European Pat. Off. . |
| 0 715 477 | 6/1996 | European Pat. Off. . |
| 0 725 498 | 8/1996 | European Pat. Off. . |
| 0 433 255 | 1/1997 | European Pat. Off. . |
| 1236535 | 6/1959 | France . |

OTHER PUBLICATIONS

*Brian Edward and Daniel Rees,* "A Broadband Printed Dipole With Integrated Balun" Microwave Journal May 1987 (pp. 339–344).

Willmar K. Roberts, "A New Wide–Band Balun" IRE, Jun. 1957 (pp. 1628–1631).

*Primary Examiner*—Don Wong
*Assistant Examiner*—Tan Ho
*Attorney, Agent, or Firm*—Arnold White & Durkee

[57] ABSTRACT

An improved antenna system for transmitting and receiving electromagnetic signals comprising a mounting plate having a length and a longitudinal axis along the length. A plurality of staggered dipole radiating elements project outwardly from a surface of the mounting plate. Each of the radiating elements includes a balanced orthogonal pair of dipoles aligned at first and second predetermined angles with respect to the longitudinal axis, forming crossed dipole pairs. The mounting plate is attached to a longitudinally extending chassis. An unbalanced feed network is connected to the radiating elements. The feed network extends along the mounting plate and is spaced from the mounting plate by a plurality of clips. The feed network is disposed between the chassis and the mounting plate. A plurality of microstrip hooks are provided, each of the microstrip hooks being positioned adjacent to, and spaced from, each of the dipoles by one of the clips.

(List continued on next page.)

62 Claims, 10 Drawing Sheets

U.S. PATENT DOCUMENTS

| | | | |
|---|---|---|---|
| 4,031,537 | 6/1977 | Alford | 343/704 |
| 4,087,818 | 5/1978 | Kreutel, Jr. | 343/176 |
| 4,180,817 | 12/1979 | Sanford | 343/700 MS |
| 4,193,077 | 3/1980 | Greenberg et al. | 343/747 |
| 4,223,317 | 9/1980 | Rod | 343/803 |
| 4,263,598 | 4/1981 | Bellee et al. | 343/700 MS |
| 4,340,891 | 7/1982 | Phillips | 343/713 |
| 4,364,050 | 12/1982 | Lopez | 343/700 MS |
| 4,412,222 | 10/1983 | Mohring et al. | 343/779 |
| 4,464,663 | 8/1984 | Lalezari et al. | 343/700 MS |
| 4,472,717 | 9/1984 | Eaves et al. | 343/5 |
| 4,504,836 | 3/1985 | Seavey | 343/761 |
| 4,518,969 | 5/1985 | Bogner | 343/819 |
| 4,571,591 | 2/1986 | Valentino et al. | 343/754 |
| 4,644,562 | 2/1987 | Kavehrad et al. | 375/14 |
| 4,658,262 | 4/1987 | DuHamel | 343/792.5 |
| 4,675,685 | 6/1987 | Finken | 343/708 |
| 4,695,844 | 9/1987 | Houchangnia | 343/781 CA |
| 4,710,775 | 12/1987 | Coe | 343/727 |
| 4,737,793 | 4/1988 | Munson et al. | 342/361 |
| 4,772,891 | 9/1988 | Svy | 343/707 |
| 4,821,039 | 4/1989 | Crane | 342/153 |
| 4,825,220 | 4/1989 | Edward et al. | 343/795 |
| 4,839,663 | 6/1989 | Kurtz | 343/771 |
| 4,870,426 | 9/1989 | Lamberty et al. | 343/705 |
| 4,929,961 | 5/1990 | Nakase | 343/715 |
| 4,943,811 | 7/1990 | Alden et al. | 343/814 |
| 5,146,234 | 9/1992 | Lalezari | 343/895 |
| 5,157,409 | 10/1992 | Hamin | 343/715 |
| 5,172,080 | 12/1992 | Fisher et al. | 333/1.1 |
| 5,206,655 | 4/1993 | Caille et al. | 343/700 MS |
| 5,220,330 | 6/1993 | Salvail et al. | 343/705 |
| 5,227,807 | 7/1993 | Bohlman et al. | 343/895 |
| 5,268,701 | 12/1993 | Smith | 343/767 |
| 5,274,391 | 12/1993 | Connolly | 343/820 |
| 5,309,165 | 5/1994 | Segal et al. | 343/770 |
| 5,319,379 | 6/1994 | Waken et al. | 343/756 |
| 5,321,414 | 6/1994 | Alden et al. | 343/816 |
| 5,400,042 | 3/1995 | Tulinsteff | 343/727 |
| 5,451,969 | 9/1995 | Toth et al. | 343/781 CA |
| 5,453,751 | 9/1995 | Tsukamoto et al. | 343/700 MS |
| 5,481,272 | 1/1996 | Yarsunas | 343/797 |
| 5,499,033 | 3/1996 | Smith | 343/700 MS |
| 5,534,877 | 7/1996 | Sorbello et al. | 343/700 MS |
| 5,589,843 | 12/1996 | Meredith et al. | 343/820 |
| 5,630,226 | 5/1997 | Kanda et al. | 343/756 |
| 5,742,258 | 4/1998 | Kumpfbeck et al. | 343/795 |
| 5,818,397 | 10/1998 | Yarsunas et al. | 343/797 |

DUAL POLARIZED BASED STATION ANTENNA

FIELD OF THE INVENTION

The present invention relates generally to the field of antennas. More particularly, it concerns a dual polarized base station antenna for wireless telecommunication systems.

BACKGROUND OF THE INVENTION

Base stations used in wireless telecommunication systems have the capability to receive linear polarized electromagnetic signals. These signals are then processed by a receiver at the base station and fed into a telephone network. In practice, the same antenna which receives the signals can also be used to transmit signals. Typically, the transmitted signals are at different frequencies than the received signals.

A wireless telecommunication system suffers from the problem of multi-path fading. Diversity reception is often used to overcome the problem of severe multipath fading. A diversity technique requires at least two signal paths that carry the same information but have uncorrelated multi-path fadings. Several types of diversity reception are used at base stations in the telecommunications industry including space diversity, direction diversity, polarization diversity, frequency diversity and time diversity. A space diversity system receives signals from different points in space requiring two antennas separated by a significant distance. Polarization diversity uses orthogonal polarization to provide uncorrelated paths.

As is well-known in the art, the sense or direction of linear polarization of an antenna is measured from a fixed axis and can vary, depending upon system requirements. In particular, the sense of polarization can range from vertical polarization (0 degrees) to horizontal polarization (90 degrees). Currently, the most prevalent types of linear polarization used in systems are those which use vertical/horizontal and +45°/−45° polarization (slant 45°). However, other angles of polarization can be used. If an antenna receives or transmits signals of two polarizations normally orthogonal, they are also known as dual polarized antennas.

An array of slant 45° polarized radiating elements is constructed using a linear or planar array of crossed dipoles located above a ground plane. A crossed dipole is a pair of dipoles whose centers are co-located and whose axes are orthogonal. The axes of the dipoles are arranged such that they are parallel with the polarization sense required. In other words, the axis of each of the dipoles is positioned at some angle with respect to the vertical or longitudinal axis of the antenna array.

One problem associated with a crossed dipole configuration is the interaction of the electromagnetic field of each crossed dipole with the fields of the other crossed dipoles and the surrounding structures which support, house and feed the crossed dipoles. As is well known in the art, the radiated electromagnetic (EM) fields surrounding the dipoles transfer energy to each other. This mutual coupling influences the correlation of the two orthogonally polarized signals. The opposite of coupling is isolation, i.e., coupling of −30 dB is equivalent to 30 dB isolation.

Dual polarized antennas have to meet a certain port-to-port isolation specification. The typical port-to-port isolation specification is 30 dB or more. The present invention increases the port-to-port isolation of a dual polarized antenna. This isolation results from the phase-adjusted re-radiated energy that cancels with the dipole mutual coupling energy.

Generally, dual polarized antennas must meet the 30 dB isolation specification in order to be marketable. Not meeting the specification means the system integrator might have to use higher performance filters which cost more and decrease antenna gain. The present invention overcomes these concerns because it meets or exceeds the 30 dB isolation specification. Additionally, dual polarized antennas generally must achieve 10 dB cross polarization discrimination at 60 degrees in order to be marketable, i.e., must achieve 10 dB cross polarization discrimination at a position perpendicularly displaced from the central axis of the antenna and 60 degrees away from the plane intersecting that axis. The present invention provides a means to meet the 10 dB cross polarization discrimination specification.

Another problem associated with prior antenna arrays is their size. Prior antenna arrays provided a plurality of radiating elements along the length of the antenna. Therefore, the length of the antenna was dictated by the number and spacing of the radiating elements. Because the gain of an antenna is proportional to the number and spacing of the radiating elements, the width and height of prior antennas could not be reduced significantly without sacrificing antenna gain.

In order to prevent corrosion, there is a need for an antenna capable of preventing water and other environmental elements from impinging upon active antenna components. One solution is providing the antenna with a protective radome. However, one problem with prior antennas is the attachment of the protective radome to the antenna. Because of the manner of attachment of prior radomes, prior radome designs allow water and other environmental elements to impinge upon active antenna components, thereby contributing to antenna corrosion (e.g., the failure of sealants such as caulk). Furthermore, because those prior radomes do not maintain seal integrity over both time and thermal excursions, such radomes allow water and other environmental contaminants to enter the antenna.

Moreover, the visual impact of base station towers on communities has become a societal concern. It has become desirable to reduce the size of these towers and thereby lessen the visual impact of the towers on the community. The size of the towers can be reduced by using base station towers with fewer antennas. This can be achieved if dual polarized antennas and polarization diversity are used. Such systems replace systems using space diversity which requires pairs of vertically polarized antennas. Some studies indicate that, for urban environments, polarization diversity provides signal quality equivalent to space diversity. With the majority of base station sites located in urban environments, it is likely that dual polarized antennas will be used in place of the conventional pairs of vertically polarized antennas. Another way to reduce the size of the base station towers is by using smaller base station antennas. The present invention addresses the problems associated with prior antennas.

SUMMARY OF THE INVENTION

An improved antenna system is provided for transmitting and receiving electromagnetic signals comprising a mounting plate having a length and a longitudinal axis along the length. A plurality of staggered dipole radiating elements project outwardly from a surface of the mounting plate. Each of the radiating elements includes a balanced orthogonal pair of dipoles aligned at first and second predetermined angles with respect to the longitudinal axis, forming crossed dipole pairs. The mounting plate is attached to a longitudinally extending chassis. An unbalanced feed network is connected to the radiating elements. The feed network extends along the mounting plate and is spaced from the mounting plate by a plurality of clips. The feed network is disposed between the chassis and the mounting plate. A plurality of microstrip hooks are provided, each of the microstrip hooks being positioned adjacent to, and spaced from, each of the dipoles by one of the clips.

The present invention therefore provides an antenna array which produces dual polarized signals. The invention also provides an antenna capable of at least 30 dB port-to-port isolation. The invention further provides an antenna capable of at least 10 dB cross polarization discrimination at 60 degrees. The invention also provides an antenna capable of high gain while reducing the width and height of the antenna by staggering the dual polarized radiating elements contained therein. The inventive antenna incorporates an axially-compliant labyrinth seal that is both integral to the radome and maintains seal integrity over both time and thermal excursions. The antenna is capable of matching an unbalanced transmission line connected to the feed network with the balanced dipole elements. The antenna is relatively inexpensive to produce because substantially all the parts in the antenna can be mass produced at a low per unit cost; the number of unique parts and total parts is relatively small; adhesive, soldering and welding is eliminated; and the number of mechanical fasteners is minimized.

DESCRIPTION OF ILLUSTRATIVE EMBODIMENTS

The present invention is useful in wireless communication systems. One embodiment of the present invention operates in a range of frequencies between 800–1,000 MHz (this includes the ESMR, GSM and cellular bands of frequencies). Generally, wireless telephone users transmit an EM signal to a base station tower that includes a plurality of antennas which receive the signal transmitted by the wireless telephone users. Although useful in wireless base stations, the present invention can also be used in all types of telecommunications systems.

Figure 1:
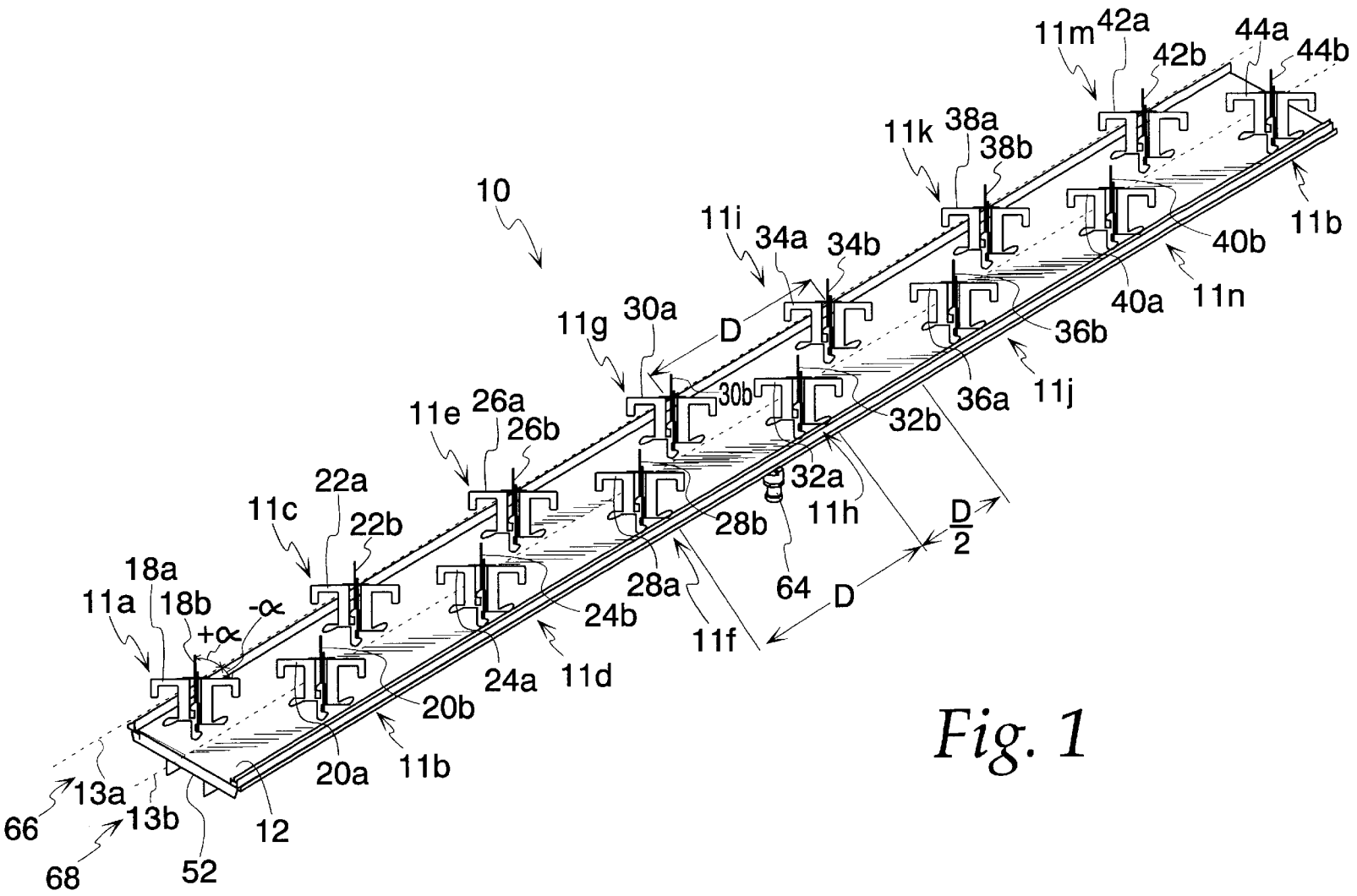
FIG. 1 is a perspective view of a top side of an antenna including a mounting plate and a plurality of staggered radiating elements.
Figure 2:
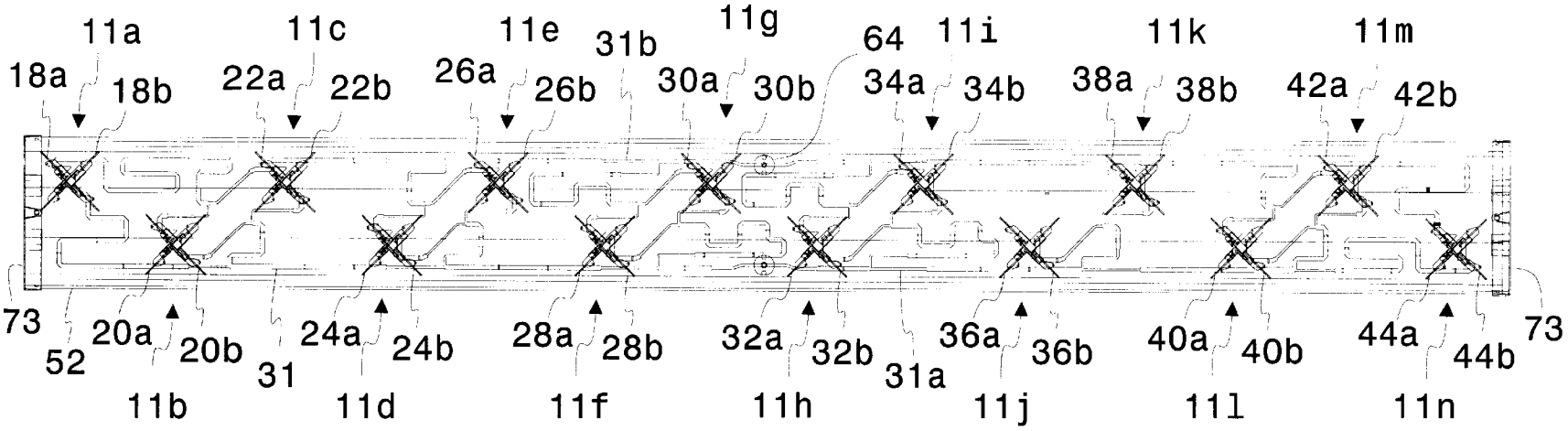
FIG. 2 is a top view of the radiating elements, the mounting plate and a feed network for the antenna illustrated in FIG. 1.
Figure 3:
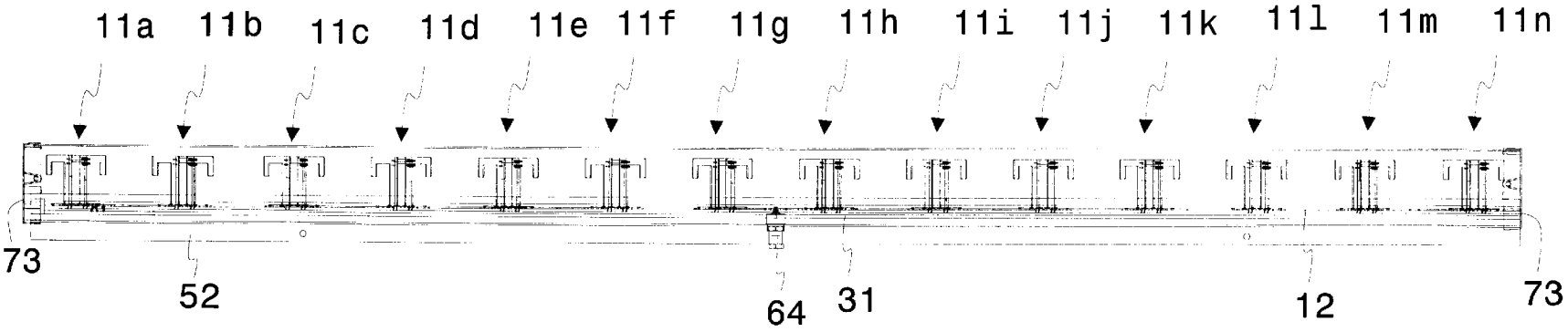
FIG. 3 is a side view of the antenna illustrated in FIG. 2.
Figure 4:
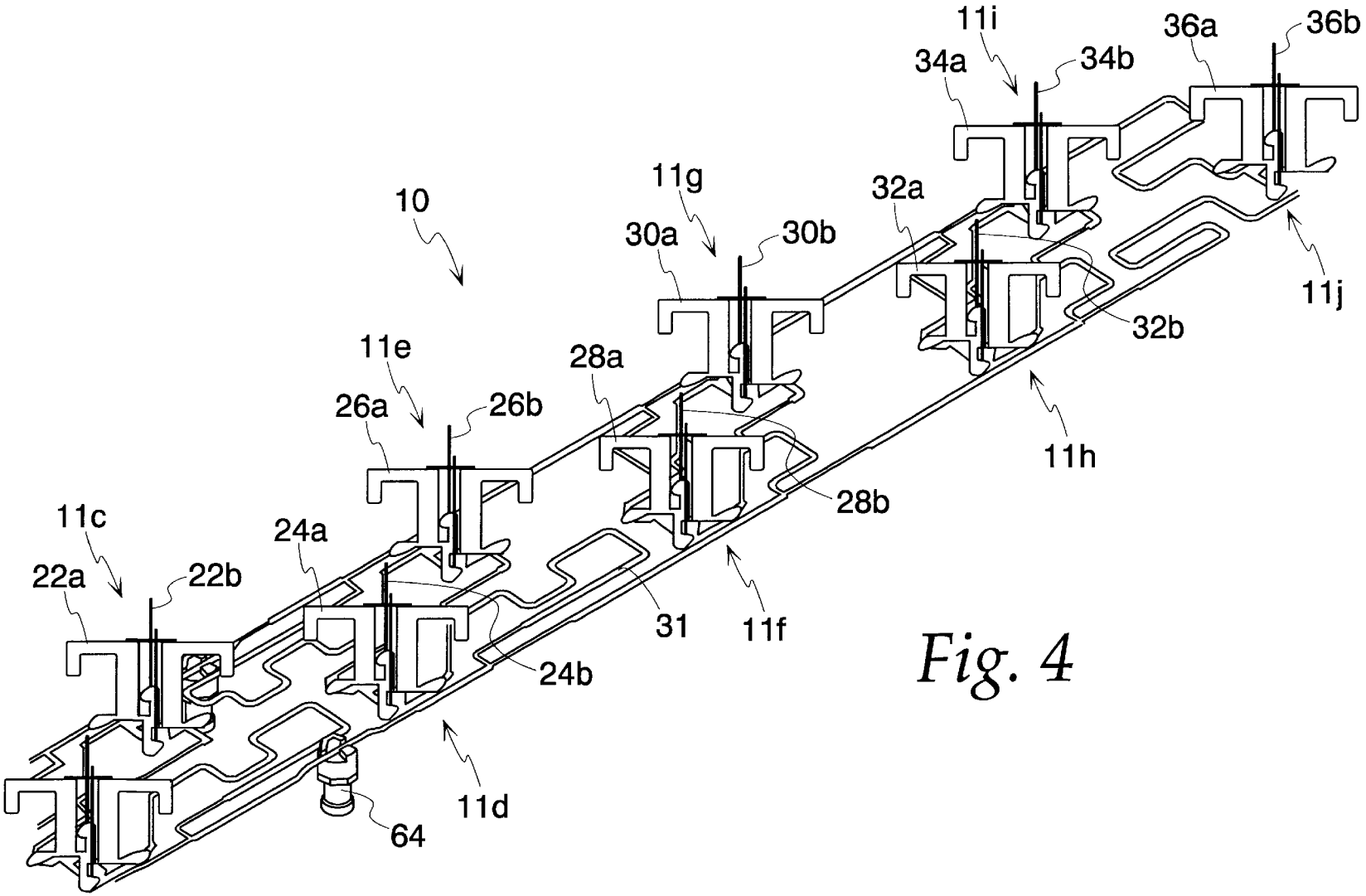
FIG. 4 is a partial perspective view of the radiating elements and the feed network for the antenna illustrated in FIG. 1.
Figure 7:
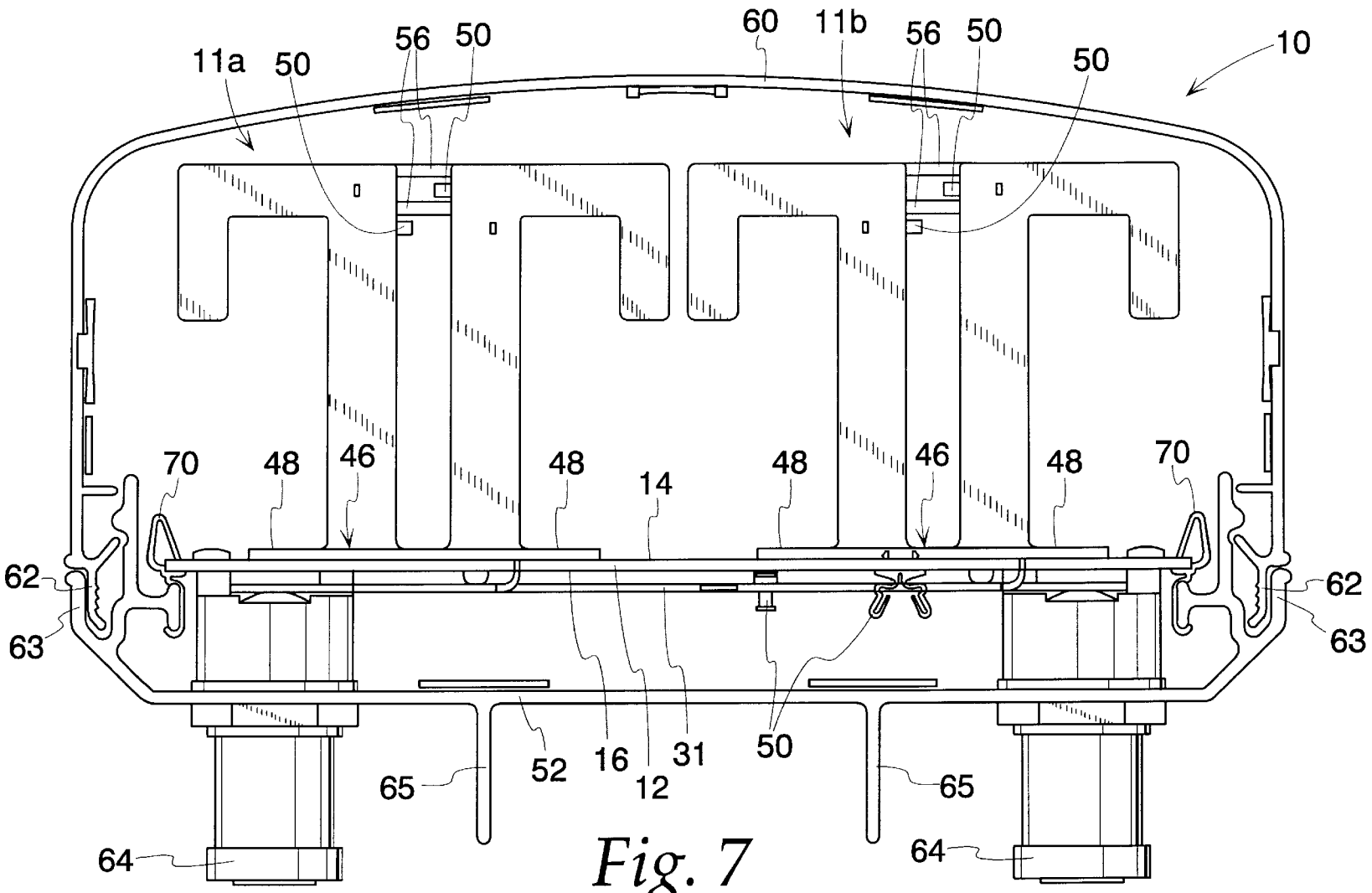
FIG. 7 is an end view of a chassis, a radome and the radiating elements for the antenna illustrated in FIG. 1.

The antenna illustrated in FIGS. 1–5 is a 55–70 degree azimuthal, half power beam width (HPBW) antenna, i.e., the antenna achieves a 3 dB beamwidth of between 55 and 70 degrees. FIG. 1 shows an antenna array 10 of crossed, dual polarized dipole radiating elements 11*a–n* that are connected to a mounting plate 12. The mounting plate 12 is a metal ground plane and, as shown in FIG. 7, has a first side 14 and a second side 16. A longitudinally extending chassis 52 houses the mounting plate 12 and the radiating elements 11*a–n*. A longitudinally extending molding 70 attaches to the chassis 52 and supports the mounting plate 12. The number of radiating elements, the amount of power presented to the feed network and the composition and dimensions of the radiating elements and the mounting plate all contribute to the radiation pattern generated by the antenna. Preferably, the radiating elements 11*a–n* and the mounting plate 12 are composed of a metal such as aluminum. However, other metals such as copper or brass can be used to construct the radiating elements 11*a–n* and the mounting plate 12.

It will be understood by those skilled in the art that the gain of the antenna is proportional to the number of staggered radiating elements present in the array and the spacing of the elements. In other words, increasing the number of radiating elements in the antenna 10 increases the gain while decreasing the number of radiating elements reduces the antenna's gain. Therefore, although 14 radiating elements are illustrated, the number of radiating elements can be increased to increase the gain. Conversely, the number of radiating elements can be decreased to reduce the gain. The gain of the antenna 10 is maximized due to the use of dipole radiating elements 11*a–n* which are efficient radiators and by using an efficient microstrip feed network 31.

The radiating elements 11*a–n* transmit and receive EM signals and are comprised of pairs of dipoles 18*a* and 18*b*, 20*a* and 20*b*, 22*a* and 22*b*, 24*a* and 24*b*, 26*a* and 26*b*, 28*a* and 28*b*, 30*a* and 30*b*, 32*a* and 32*b*, 34*a* and 34*b*, 36*a* and 36*b*, 38*a* and 38*b*, 40*a* and 40*b*, 42*a* and 42*b*, and 44*a* and 44*b*, respectively. The radiating elements 11*a–n* form angles of +45 degrees and −45 degrees with respect to the longitudinal axis 13*a* or 13*b*, respectively. Each of the radiating elements 11*a–n* receives signals having polarizations of +45 degrees and −45 degrees. That is, the axes of the dipoles are arranged such that they are parallel with the polarization sense required. In the illustrated embodiment of FIG. 1, the slant angles $+\alpha$ and $-\alpha$ are +45 degrees and −45 degrees, respectively. Although shown with slant angles of +45 degrees and 45 degrees, it will be understood by those skilled in the art that these angles can be varied to optimize the performance of the antenna. Furthermore, the angles $+\alpha$ and $-\alpha$ need not be identical in magnitude. For example, $+\alpha$ and $-\alpha$ can be +30 degrees and −60 degrees, respectively. In the illustrated embodiment of FIG. 1, one dipole in each of the radiating elements 11*a–n* receives signals having polarizations of +45 degrees while the other dipole in each of the radiating elements 11*a–n* receives signals having polarizations of −45 degrees.

Figure 5:
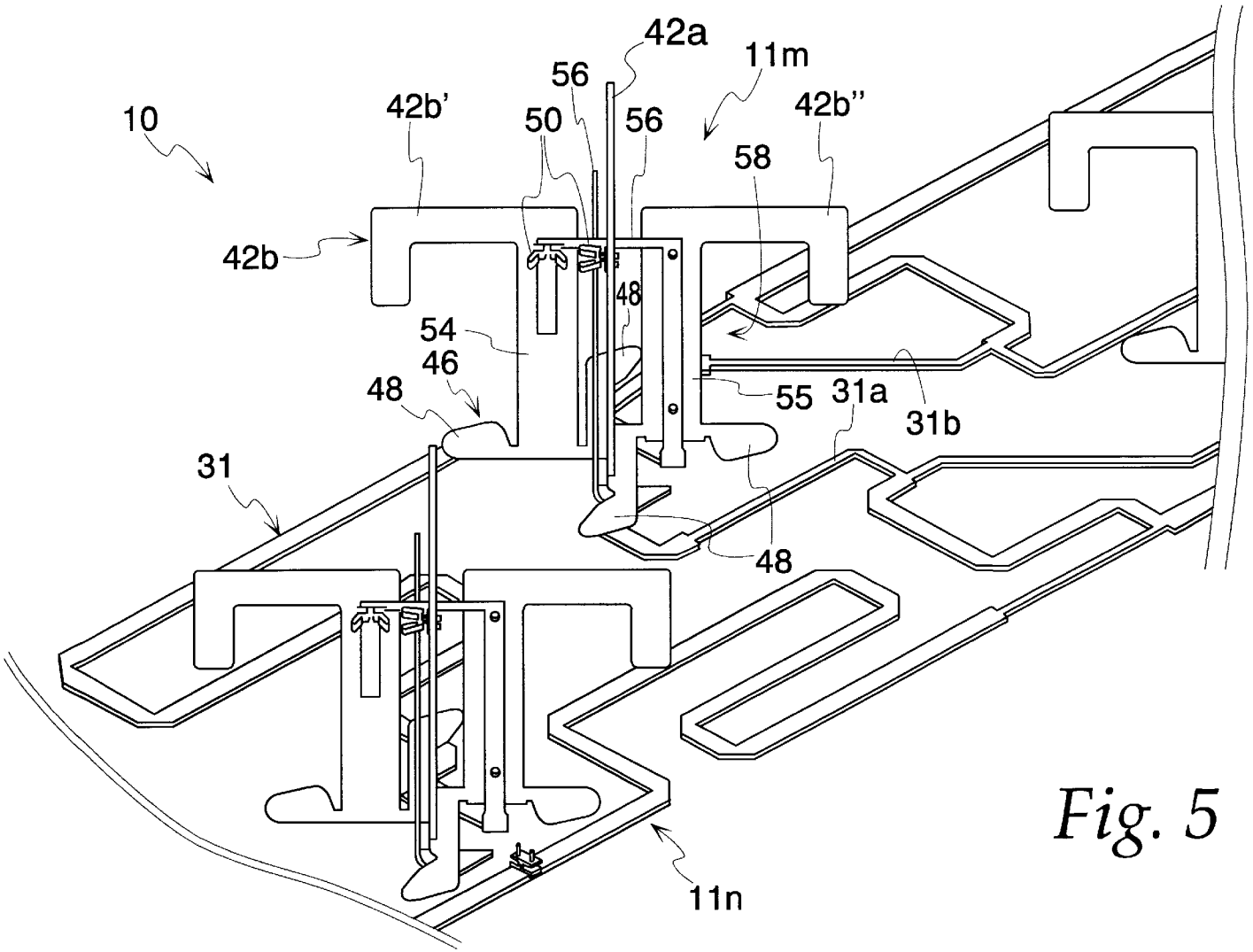
FIG. 5 is a partial perspective view of radiating elements, microstrip hooks, and the feed network for the antenna illustrated in FIG. 1
Figure 8:
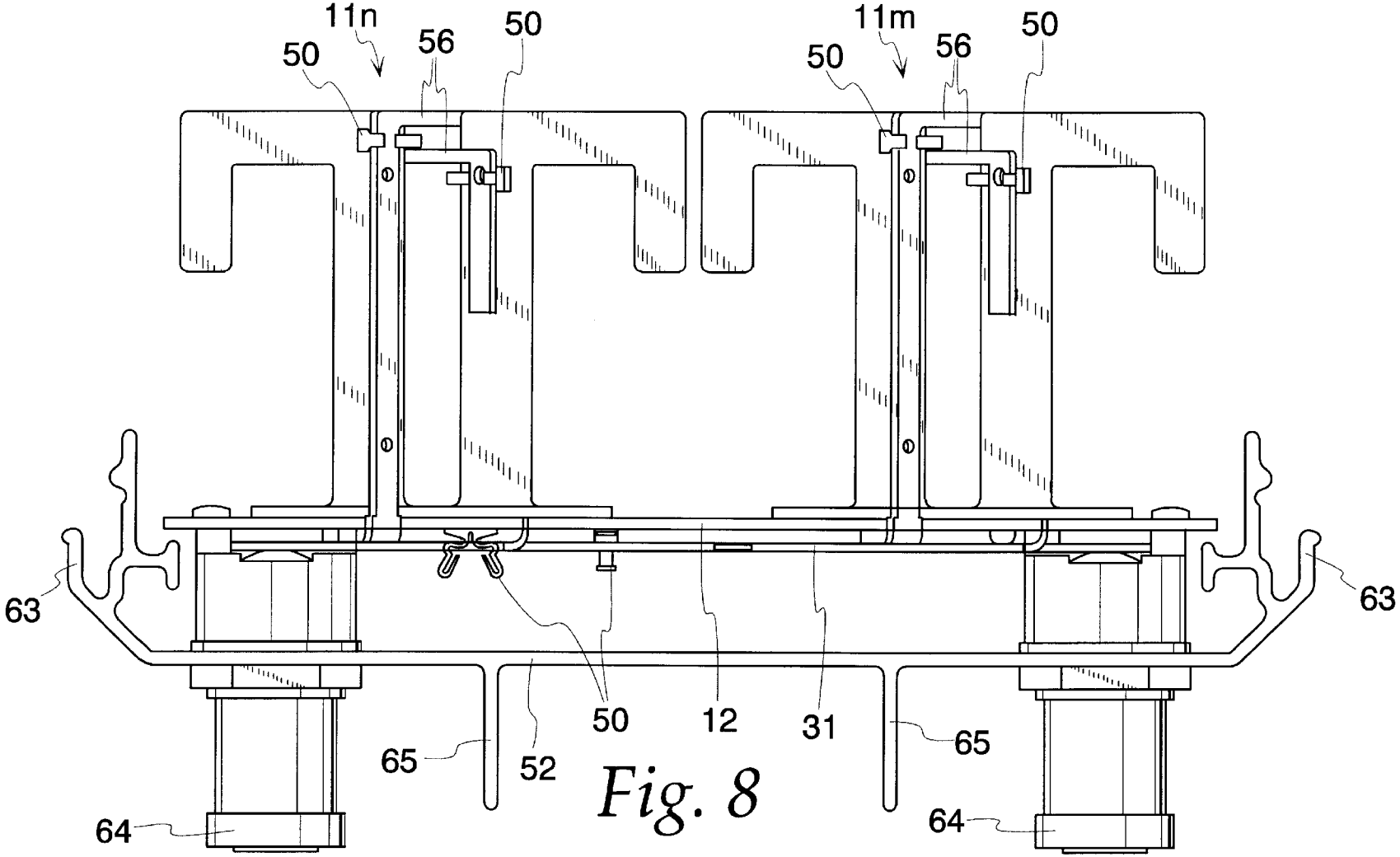
FIG. 8 is an end view of the opposite end of the antenna illustrated in FIG. 7 showing the chassis and the radiating elements.
Figure 9:
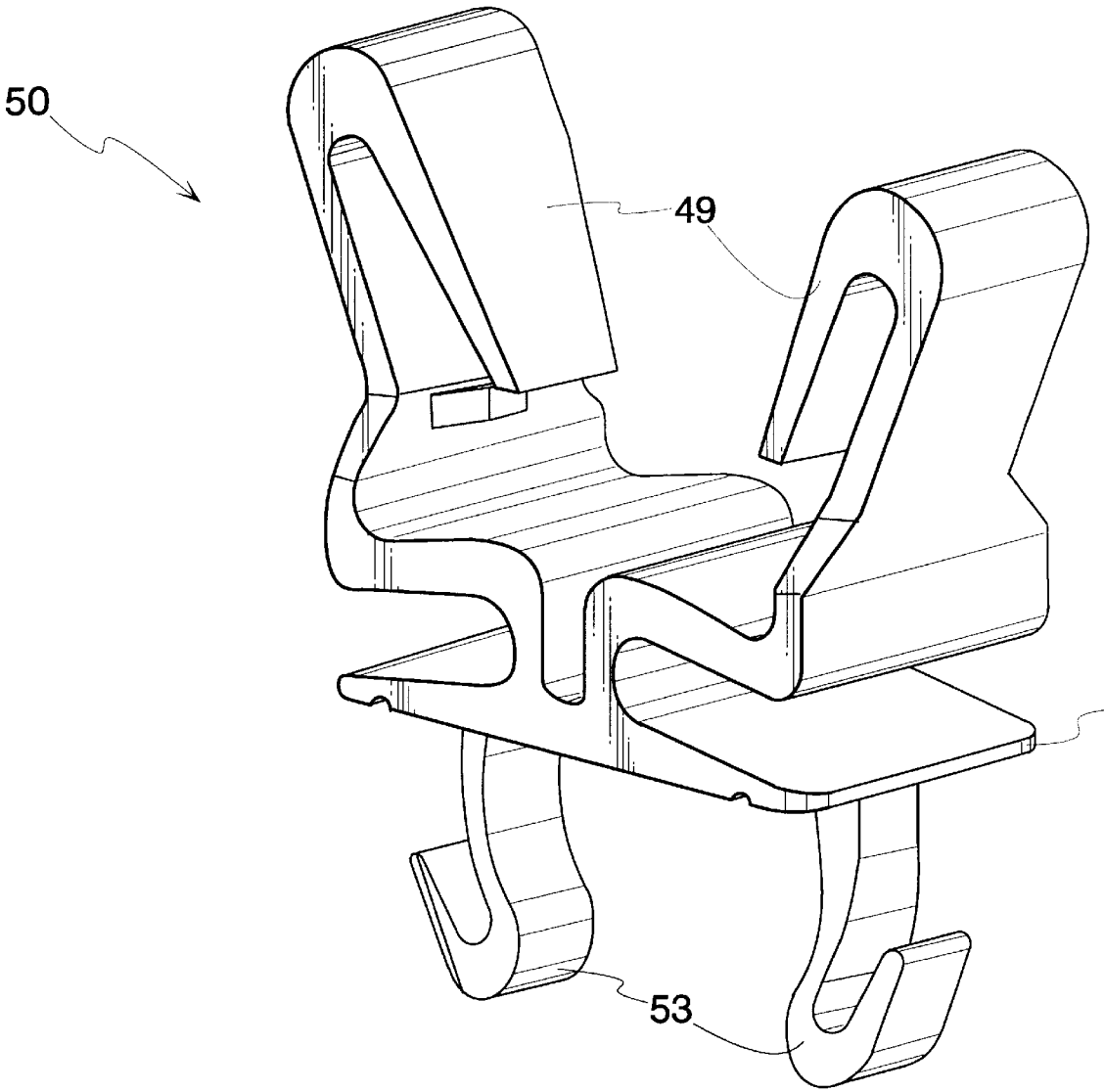
FIG. 9 is a perspective view of a clip used to secure the feed network and the microstrip hooks illustrated in FIGS. 1–8.
Figure 11:
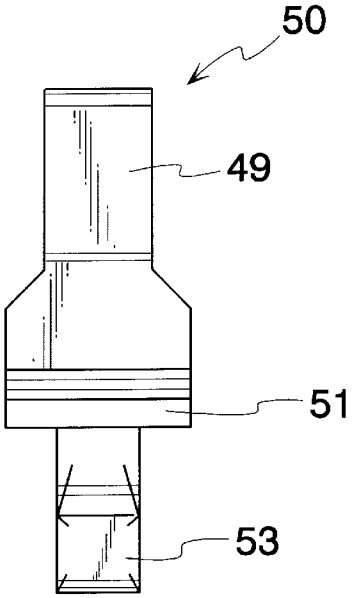
FIG. 11 is a side view of the clip illustrated in FIG. 9.
Figure 12:
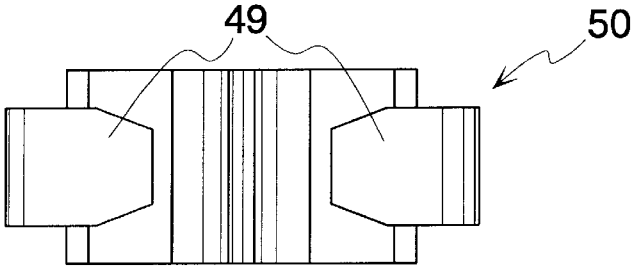
FIG. 12 is a top view of the clip illustrated in FIG. 9.
Figure 10:
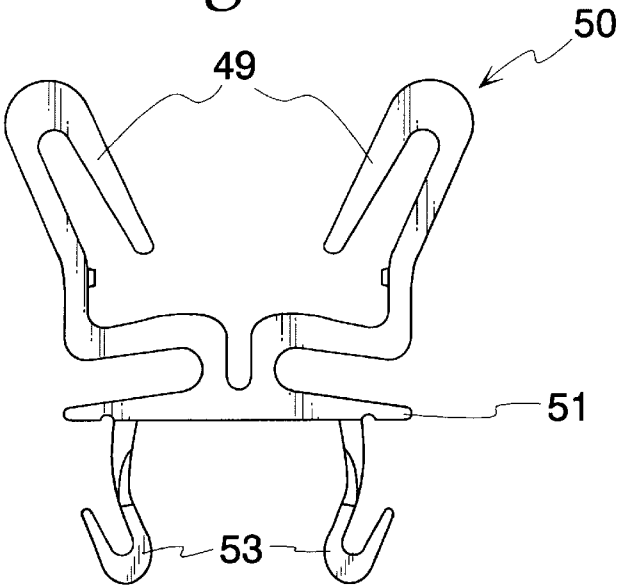
FIG. 10 is a front view of the clip illustrated in FIG. 9.

As illustrated in FIG. 5, the feed network 31 comprises two branches 31*a* and 31*b*. Branch 31*a* is electromagnetically coupled to each of the parallel dipoles 18*a*, 20*a*, 22*a*, 24*a*, 26*a*, . . . , and 44*a* by a microstrip hook adjacent to each of the respective dipoles. Branch 31*b* is electromagnetically coupled to each of the parallel dipoles 18*b*, 20*b*, 22*b*, 24*b*, 26*b*, . . . , and 44*b* by a microstrip hook adjacent to each of the respective dipoles. The received signals from parallel dipoles 18*a*, 20*a*, 22*a*, 24*a*, 26*a*, . . . , and 44*a* are distributed to a receiver using branch 31*a* for that polarization. Likewise, the received signals from parallel dipoles 18*b*, 20*b*, 22*b*, 24*b*, 26*b*, . . . , and 44*b* are distributed to a receiver using branch 31*b* for the other polarization. As illustrated in FIGS. 7–8, the feed network 31 extends along the mounting plate 12 and is spaced below the second side 16 of the mounting plate 12 by a plurality of clips 50. The feed network 31 is located between the mounting plate 12 and the chassis 52 in order to isolate the feed network 31 from the radiating elements 11*a–n* and to substantially reduce the amount of EM radiation from the feed network 31 that escapes from the antenna 10. The feed network 31 distributes the received signals from the radiating elements 11*a–n* to a diversity receiver for further processing. Each of the radiating elements 11*a–n* can also act as a transmitting antenna.

Figure 6:
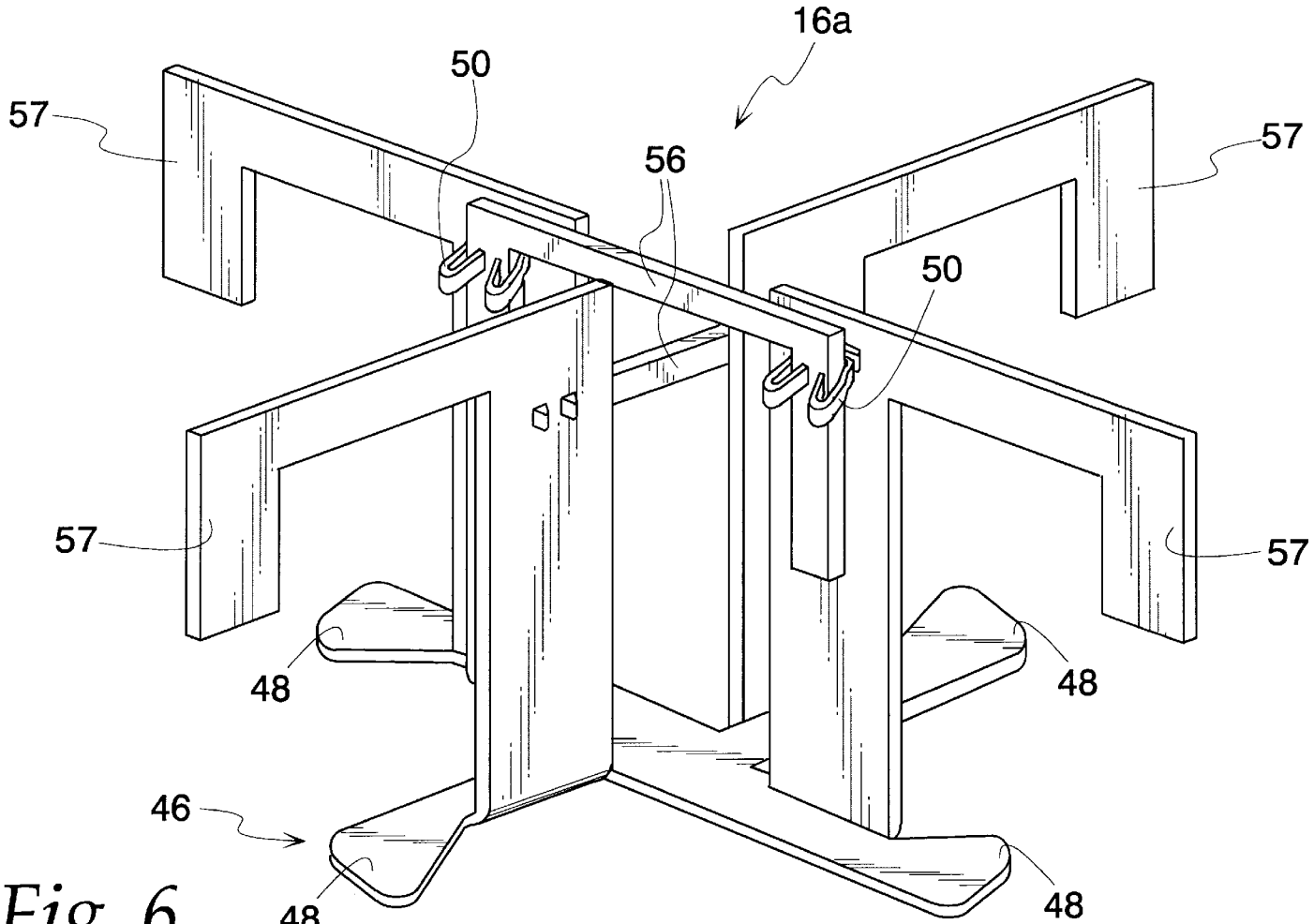
FIG. 6 is a perspective view of one radiating element and its microstrip hooks for the antenna illustrated in FIG. 1

Each dipole is comprised of a metal such as aluminum. Each dipole includes two half dipoles. For example, as illustrated in FIG. 5, the dipole 42*b* includes half dipoles 42*b*' and 42*b*". Each of the half dipoles has a generally inverted L-shaped profile, as illustrated in FIG. 5. The four half dipoles that comprise one radiating element are all physically part of the same piece of metal, as illustrated in FIG. 6, and are all at earth ground at DC. However, each of the two dipoles that comprise a radiating element operate independently at RF. As shown in FIG. 5, each half dipole is attached to the other three half dipoles at the base 46 of each radiating element. The base 46 includes four feet 48 that allow the radiating element to be attached to the mounting plate 12 (shown in FIG. 5 and 6). The radiating elements are attached to the mounting plate 12 by a cold forming process developed by Tox Pressotechnik GmbH of Weingarten, Germany (the cold forming process). The cold forming process deforms the four metal feet 48 and the metal mounting plate 12 together at a button. The cold forming process uses pressure to lock the metal of the feet 48 and the metal of the mounting plate 12 together. This process eliminates the need for mechanical fasteners to secure the radiating elements to the mounting plate 12.

The present invention also improves the cross polarization discrimination of antenna 10. As illustrated in FIG. 5, a downwardly extending vertical portion 57 is provided at the distal end of each generally L-shaped dipole. The vertical portion 57 improves the cross polarization discrimination of the antenna such that at least 10 dB cross polarization discrimination is achieved at 60 degrees.

A portion of each generally L-shaped half dipole forms a vertical support. For example, as illustrated in FIG. 5, half dipole 42*b*' includes vertical support 54 and half dipole 42*b*" includes vertical support 55. A microstrip hook is attached to, and spaced from, each of the dipoles by one of the clips 50. The microstrip hooks electromagnetically couple each dipole to the feed network 31. For example, adjacent dipole 42*b* is microstrip hook 56 which is integral with branch 31*b* of the feed network 31. A balanced/unbalanced (balun) transformer 58 is provided for each of the dipoles 18*a*, 18*b*, 20*a*, 20*b*, 22*a*, 22*b*, 24*a*, 24*b*, 26*a*, 26*b*, . . . , 44*a* and 44*b*. The general operation of a balun is well known in the art and is described in an article by Brian Edward & Daniel Rees, *A Broadband Printed Dipole with Integrated Balun*, MICROWAVE JOURNAL, May 1987, at 339–344, which is incorporated herein by reference. Each of the baluns 58 comprise one microstrip hook and the vertical support for each half dipole. For example, as illustrated in FIG. 5, the dipole 42*b* includes the balun 58 which comprises the microstrip hook 56 and the vertical supports 54 and 55. Each of the microstrip hooks 56 is generally shaped like an inverted U. However, in order to achieve a symmetrical pair of crossed dipoles, one leg of the inverted U is substantially longer than the other leg. The baluns 58 match the unbalanced transmission lines connected to the feed network 31 with the balanced pairs of dipole elements 18*a* and 18*b*, 20*a* and 20*b*, 22*a* and 22*b*, 24*a* and 24*b*, 26*a* and 26*b*, . . . , and 44*a* and 44*b*, respectively. The microstrip hooks 56 are each integrally connected to the feed network 31. The plurality of microstrip hooks 56 are each attached to, and spaced from, each of their respective dipoles by one of the clips 50. The clips 50 are composed of a dielectric material such as, for example, a glass fiber loaded polypropylene. As illustrated in FIGS. 9–12, each of the clips 50 include two generally U-shaped upper projections 49 extending upwardly from a base 51 and two generally U-shaped lower projections 53 extending downwardly from the base 51. The lower projections 53 allow the clips 50 to attach to, for example, one of the dipoles or the mounting plate. The upper projections 49 allow the clips 50 to attach, for example, the feed network 31 to the mounting plate 12 or one of the microstrip hooks 56 to one of the dipoles.

FIG. 7 illustrates a radome 60 that encloses the antenna array 10. The radome 60 includes two longitudinally extending bottom edges 62 that are integrally formed with the radome 60. The chassis 52 includes two longitudinally extending rails 63. The radome 60 is secured to the antenna 10 by, for example, sliding the radome 60 onto the chassis 52 such that the longitudinally extending bottom edges 62 are in spring engagement with the rails 63 of the chassis 52. Alternatively, the radome 60 is secured to the antenna 10 by snapping the bottom edges 62 into the rails 63 of the chassis. The tight, frictional engagement between the bottom edges 62 and the rails 63 inhibits water and other environmental elements from entering the antenna, to prevent corrosion of the antenna 10. The guide rails secure the radome 60 to the antenna 10 and prevent movement of the radome 60 with respect to the chassis 52 in two directions, i.e., laterally and vertically away from the mounting plate 12. End caps 73 snap onto the ends of the antenna 10 to seal in the radiating elements 11*a–n* and to protect the antenna 10 from adverse environmental conditions. Extending through the chassis 52 approximately halfway down the length of the antenna 10 are a pair of connectors 64 that electrically connect branch 31*a* and branch 31*b* of the feed network 31 with, for example, an external receiver or transmitter. Alternatively, the connectors 64 may be located in one of the end caps of the antenna 10. A pair of integrated mounting bracket interfaces 65 extend along the exterior of the chassis 52 and allow the antenna 10 to be connected to a base station tower.

In the illustrated embodiment of FIG. 1, the 14 crossed dipole radiating elements 11*a–n* are attached to a mounting plate 2.6 m long by 0.25 m wide. The antenna 10 operates in a range of frequencies between 800–1,000 MHz (this includes the ESMR, GSM and cellular bands of frequencies). The longitudinal axes 13*a* and 13*b* extend along the longitudinal length of the array 10. Seven of the radiating elements (11*a*, 11*c*, 11*e*, 11*g*, 11*i*, 11*k*, and 11*m*) are aligned along the longitudinal axis 13*a* while the other seven radiating elements (11*b*, 11*d*, 11*f*, 11*h*, 11*j*, 11*l*, and 11*n*) are aligned along the longitudinal axis 13*b*. Thus, the radiating elements are aligned in a first longitudinally extending row 66 and a second longitudinally extending row 68 on the mounting plate 12. Each radiating element in the first row 66 is staggered from each of the radiating elements in the second row 68. As illustrated in FIG. 1, the radiating elements in row 66 and the radiating elements in row 68 are each longitudinally separated from each other by a distance D. However, the radiating elements in the first row 66 are longitudinally separated from the radiating elements in the second row 68 by a distance equal to approximately D/2.

The antenna of the present invention includes dual polarized radiating elements that produce two orthogonally polarized signals. The present invention further provides an antenna array comprised of crossed dipoles. The invention comprises a plurality of staggered radiating elements that provide the antenna with high gain while reducing the width and height of the antenna. The elements of the inventive antenna improve the isolation between the EM fields produced by the crossed dipoles. The downwardly extending vertical portion at the distal end of each generally L-shaped dipole improves the cross polarization discrimination of the antenna such that at least 10 dB cross polarization discrimination is achieved at 60 degrees. The antenna also minimizes the number of antennas required in a wireless telecommunication system, thereby providing an aesthetically pleasing base station that is of minimum size. The inventive antenna incorporates an axially-compliant labyrinth seal that is both integral to the radome and maintains seal integrity over both time and thermal excursions. The antenna is less expensive to produce because substantially all the parts in the antenna can be mass produced at a low per unit cost; the number of unique parts and total parts is relatively small; adhesive, soldering and welding is eliminated; and the number of mechanical fasteners is minimized.

While the present invention has been described with reference to one or more preferred embodiments, those skilled in the art will recognize that many changes may be made thereto without departing from the spirit and scope of the present invention which is set forth in the following claims.

We claim:

1. An antenna for transmitting and receiving electromagnetic signals comprising:

a mounting plate having a longitudinal axis;

a plurality of dipole radiating elements projecting outwardly from a surface of said mounting plate, each of said radiating elements including a balanced orthogonal pair of dipoles aligned at first and second predetermined angles with respect to said longitudinal axis, forming crossed dipole pairs;

an unbalanced feed network electromagnetically coupled to said radiating elements; and a plurality of microstrip hooks, each of said microstrip hooks being positioned adjacent to, and spaced from, each of said dipoles by a microstrip clip.

2. The antenna of claim 1, wherein said feed network extends along said mounting plate and is spaced from said mounting plate by a plurality of feed network clips.

3. The antenna of claim 2, wherein said feed network clips and said microstrip clip have the same configuration.

4. The antenna of claim 1, wherein said feed network includes microstrip transmission lines spaced from said mounting plate by a plurality of feed network clips.

5. The antenna of claim 1, wherein said microstrip clip is composed of a dielectric material.

6. The antenna of claim 1, wherein said microstrip clip includes two generally U-shaped projections extending upwardly from a base of said clip and two generally U-shaped projections extending downwardly from said base.

7. The antenna of claim 1, wherein said radiating elements are comprised of metal.

8. The antenna of claim 1, wherein said radiating elements are attached to said mounting plate such that each of said pairs of dipoles are generally orthogonal to said surface of said mounting plate.

9. The antenna of claim 1, wherein each of said radiating elements includes four half dipoles and each of said radiating elements includes a base with four feet.

10. The antenna of claim 9, wherein each of said feet is attached to said mounting plate by a cold forming method.

11. The antenna of claim 1, wherein said dipoles comprise two half dipoles, each of said half dipoles having a generally inverted L-shaped profile, a portion of said generally L-shaped profile forming a vertical support.

12. The antenna of claim 11, further including a balun comprised of one of said microstrip hooks and said vertical support for each half dipole.

13. The antenna of claim 12, wherein each said microstrip hook is separated from said vertical support for each half dipole by an air dielectric.

14. The antenna of claim 1, wherein each of said microstrip hooks is generally shaped like an inverted U.

15. The antenna of claim 1, whereby said first predetermined angle is substantially equal to +45 degrees with respect to said longitudinal axis and said second predetermined angle is substantially equal to −45 degrees with respect to said longitudinal axis.

16. The antenna of claim 1, further comprising a longitudinally extending chassis, said mounting plate being attached to said chassis.

17. The antenna of claim 16, further comprising a longitudinally extending molding that attaches to said chassis and supports said mounting plate.

18. The antenna of claim 1, further comprising a radome having integral guide rails that secure said radome to said antenna.

19. The antenna of claim 18, further comprising a longitudinally extending chassis, wherein said guide rails secure said radome to said chassis.

20. The antenna of claim 1, wherein said mounting plate is a ground plane comprised of metal.

21. An antenna for transmitting and receiving electromagnetic signals comprising:

a mounting plate having a longitudinal axis;

a plurality of staggered dipole radiating elements projecting outwardly from a surface of said mounting plate, each of said radiating elements including a balanced orthogonal pair of dipoles aligned at first and second predetermined angles with respect to said longitudinal axis, forming crossed dipole pairs; and an unbalanced feed network electromagnetically coupled to said radiating elements.

22. The antenna of claim 21, further comprising a plurality of microstrip hooks, each of said microstrip hooks being positioned adjacent to, and spaced from, each of said dipoles by a clip.

23. The antenna of claim 21, wherein said feed network includes microstrip transmission lines that extend along said mounting plate and are spaced from said mounting plate by a plurality of clips.

24. The antenna of claim 21, wherein said staggered radiating elements are aligned in a first longitudinally extending row and a second longitudinally extending row on said mounting plate, the radiating elements in each of said rows being longitudinally separated from each other by a distance D, said radiating elements in said first row being longitudinally separated from said radiating elements in the second row by a distance equal to approximately D/2.

25. The antenna of claim 21, further including a longitudinally extending chassis, said mounting plate being attached to said chassis.

26. The antenna of claim 25, further comprising a longitudinally extending molding that attaches to said chassis and supports said mounting plate.

27. The antenna of claim 25, wherein said feed network extends along said mounting plate and is disposed between said chassis and said mounting plate.

28. The antenna of claim 21, wherein said radiating elements are comprised of metal.

29. The antenna of claim 21, wherein said radiating elements are attached to said mounting plate such that each of said pairs of dipoles are generally orthogonal to said surface of said mounting plate.

30. The antenna of claim 21, wherein each of said radiating elements includes four half dipoles and each of said radiating elements includes a base with four feet.

31. The antenna of claim 30, wherein each of said feet are attached to said mounting plate by a cold forming method.

32. The antenna of claim 21, wherein said dipoles comprise two half dipoles, each of said half dipoles having a generally inverted L-shaped profile, a portion of said generally L-shaped profile forming a vertical support.

33. The antenna of claim 32, further including a balun comprised of one of said microstrip hooks and said vertical support for each half dipole.

34. The antenna of claim 32, wherein each said microstrip hook is separated from said vertical support for each half dipole by an air dielectric.

35. The antenna of claim 21, wherein each of said microstrip hooks is generally shaped like an inverted U.

36. The antenna of claim 21, whereby said first predetermined angle is substantially equal to +45 degrees with respect to said longitudinal axis and said second predetermined angle is substantially equal to −45 degrees with respect to said longitudinal axis.

37. The antenna of claim 21, further comprising a radome having integral guide rails that secure said radome to said antenna.

38. The antenna of claim 37, further comprising a longitudinally extending chassis, wherein said guide rails secure said radome to said chassis.

39. The antenna of claim 21, wherein said mounting plate is a ground plane comprised of metal.

40. An antenna for transmitting and receiving electromagnetic signals comprising:

a mounting plate having a longitudinal axis;

a plurality of dipole radiating elements projecting outwardly from a surface of said mounting plate, each of said elements including a balanced orthogonal pair of dipoles aligned at first and second predetermined angles with respect to said longitudinal axis, forming crossed dipole pairs;

a longitudinally extending chassis, said mounting plate being attached to said chassis; and an unbalanced feed network electromagnetically coupled to said radiating elements, said feed network extending along said mounting plate and being disposed between said chassis and said mounting plate.

41. The antenna of claim 40, further comprising a longitudinally extending molding that attaches to said chassis and supports said mounting plate.

42. The antenna of claim 40, further comprising a plurality of microstrip hooks, each of said microstrip hooks being positioned adjacent to, and spaced from, each of said dipoles by a clip.

43. The antenna of claim 42, wherein each of said microstrip hooks is generally shaped like an inverted U.

44. The antenna of claim 40, wherein said feed network extends along said mounting plate and is spaced from said mounting plate by a plurality of clips.

45. The antenna of claim 40, wherein said radiating elements are staggered such that they are aligned in a first longitudinally extending row and a second longitudinally extending row on said mounting plate, the radiating elements in each of said rows being longitudinally separated from each other by a distance D, said radiating elements in said first row being longitudinally separated from said radiating elements in the second row by a distance equal to approximately D/2.

46. The antenna of claim 40, wherein said radiating elements are attached to said mounting plate such that each of said pairs of dipoles are generally orthogonal to said surface of said mounting plate.

47. The antenna of claim 40, wherein each of said radiating elements includes four half dipoles and each of said radiating elements includes a base with four feet.

48. The antenna of claim 47, wherein each of said feet are attached to said mounting plate by a cold forming method.

49. The antenna of claim 40, wherein said dipoles comprise two half dipoles, each of said half dipoles having a generally inverted L-shaped profile, a portion of said generally L-shaped profile forming a vertical support.

50. The antenna of claim 49, further including a balun comprised of a microstrip hook and said vertical support for each half dipole.

51. The antenna of claim 50, wherein said microstrip hook is separated from said vertical support for each half dipole by an air dielectric.

52. The antenna of claim 40, whereby said first predetermined angle is substantially equal to +45 degrees with respect to said longitudinal axis and said second predetermined angle is substantially equal to −45 degrees with respect to said longitudinal axis.

53. The antenna of claim 40, further comprising a radome having integral guide rails that secure said radome to said antenna.

54. A method for assembling an antenna that receives and transmits electromagnetic signals comprising:

providing a mounting plate having a length and a longitudinal axis along said length;

providing a plurality of dipole radiating elements projecting outwardly from a surface of said mounting plate, each of said elements including a balanced orthogonal pair of dipoles aligned at first and second predetermined angles with respect to said longitudinal axis, forming crossed dipole pairs;

attaching said mounting plate to a longitudinally extending chassis; and electromagnetically coupling an unbalanced feed network to said radiating elements, said feed network extending along said mounting plate and being disposed between said chassis and said mounting plate.

55. The method of claim 54, comprising the further step of spacing said feed network from said mounting plate by a plurality of clips.

56. The method of claim 54, further comprising the step of positioning a microstrip hook adjacent to one of said dipoles by a clip that spaces said microstrip hook from said dipole.

57. The method of claim 54, comprising the further steps of forming each of said dipole pairs from metal plates and attaching said plates to said mounting plate so said plates are generally orthogonal to said surface of said mounting plate.

58. The method of claim 54, further comprising the step of providing a longitudinally extending molding that attaches to said chassis and supports said mounting plate.

59. The method of claim 54, further comprising the step of staggering said radiating elements such that they are aligned in a first longitudinally extending row and a second longitudinally extending row on said mounting plate, the radiating elements in each of said rows being longitudinally separated from each other by a distance D, said radiating elements in said first row being longitudinally separated from said radiating elements in the second row by a distance equal to approximately D/2.

60. The method of claim 54, further comprising the steps of attaching said radiating elements to said mounting plate such that each of said pairs of dipoles are generally orthogonal to said surface of said mounting plate.

61. The method of claim 54, wherein each of said radiating elements includes four half dipoles and each of said radiating elements includes a base with four feet, further comprising the step of attaching each of said feet to said mounting plate by a cold forming method.

62. The method of claim 54, further comprising the step of attaching a radome, having integral guide rails, to said antenna.

* * * * *